US006642645B2

(12) United States Patent
Kim et al.

(10) Patent No.: US 6,642,645 B2
(45) Date of Patent: Nov. 4, 2003

(54) TENSION MASK ASSEMBLY FOR COLOR CRT HAVING VIBRATION ATTENATION UNITS

(75) Inventors: Dong-Hwan Kim, Suwon (KR); Woo-Il Park, Kyungki-do (KR)

(73) Assignee: Samsung SDI Co., Ltd., Suwon (KR)

( * ) Notice: Subject to any disclaimer, the term of this patent is extended or adjusted under 35 U.S.C. 154(b) by 65 days.

(21) Appl. No.: 09/962,676

(22) Filed: Sep. 26, 2001

(65) Prior Publication Data

US 2002/0070656 A1 Jun. 13, 2002

(30) Foreign Application Priority Data

Dec. 8, 2000 (KR) ..... 2000-74795

(51) Int. Cl.[7] ..... H01J 29/80

(52) U.S. Cl. ..... 313/407; 313/402; 313/403; 313/404

(58) Field of Search ..... 313/407, 402, 313/403, 404

(56) References Cited

U.S. PATENT DOCUMENTS 4,827,178 A * 5/1989 Higashinakagawa et al. ..... 313/402
5,162,694 A * 11/1992 Capek et al. ..... 313/407
5,336,963 A * 8/1994 Haga et al. ..... 313/402
6,469,431 B1 * 10/2002 Suzuki et al. ..... 313/407

FOREIGN PATENT DOCUMENTS

EP 0 984 482 A2 3/2000
JP 2000-77007 3/2000

* cited by examiner

*Primary Examiner*—Vip Patel
*Assistant Examiner*—Kevin Quarterman
(74) *Attorney, Agent, or Firm*—Robert E. Bushnell, Esq.

(57) ABSTRACT

A tension mask assembly for a color cathode-ray tube includes a tension mask including a plurality of strips separated a predetermined distance from each other to form slots, a plurality of bridges connecting the strips to section the slots, and a plurality of holes formed in each of short side portions of the tension mask, a frame including first and second support members supporting both long side portions of the tension mask to apply a tension force to the strips of the tension mask, and at least a pair of elastic members supporting the first and second support members, and a plurality of vibration attenuation units coupled to the holes formed at both short side portions of the tension mask to attenuate vibrations of the tension mask.

28 Claims, 4 Drawing Sheets

TENSION MASK ASSEMBLY FOR COLOR CRT HAVING VIBRATION ATTENATION UNITS

This application makes reference to, incorporates the same herein, and claims all benefits accruing under 35 U.S.C. §119 from an application for Tension Mask Assembly for Color CRT earlier filed in the Korean Industrial Property Office on Dec. 8, 2000 and there duly assigned Serial No. 2000-74795.

BACKGROUND OF THE INVENTION

1. Field of the Invention

The present invention relates to a color cathode-ray tube (CRT), and more particularly, to a tension mask assembly for a color cathode-ray tube having a technique for attenuating vibrations of a tension mask due to external impacts.

2. Description of the Background Art

In a typical color cathode-ray tube an electron gun installed in a neck portion of a funnel emits three types of electron beams of red, green and blue colors. These electron beams pass through hundreds of thousands of electron beam passing holes formed in the surface of a shadow mask having a color selection function. The electron beams passing through the electron beam passing holes land at red, green and blue fluorescent materials of a fluorescent film formed on the inner surface of a panel which is coupled to the funnel forming a seal. Thus, the fluorescent materials are excited so that a predetermined image is formed.

In the above color cathode-ray tube, to improve a view angle of a view and prevent distortion of an image, making a flat screen surface has been required. Accordingly, the shadow mask installed inside the color cathode-ray tube and having a color selection function is needed to be made flat.

For this purpose, in an earlier shadow mask of a color cathode-ray tube has a frame including first and second support members installed parallel to each other and first and second elastic members of which end portions are secured to each of the first and second support members. A flat type tension mask having slots with electron beam passing holes formed in strips therein as a plurality of strips are connected by bridges is welded to the first and second support members and while a tension force is applied thereto.

However, in the earlier tension mask assembly for a color cathode-ray tube, the tension mask formed of a thin plate having a thickness of 0.1 through 0.25 mm (millimeters) is welded to the frame by being tensioned. In particular, since only the long side edges thereof are secured to the support members while the short side edges hereof are not secured, the tension mask easily vibrates by small impacts applied from the outside.

Thus, the electron beams emitted from the electron gun do not pass the electron beam passing holes at an accurate amount so that they are not able to accurately land at a predetermined position of the fluorescent material. Accordingly, a howling phenomenon that an image vibrates is generated and resolution of an image is lowered. An exemplar of art is a mask frame assembly reducing vibrations using a damper operation disclosed in Japanese Patent Publication No. 2000-77007 and European Patent Application EP0984482A2 by Suzuki for Color Cathode-ray Tube.

SUMMARY OF THE INVENTION

It is therefore an object of the present invention to provide a tension mask assembly for a color cathode-ray tube having a vibration attenuation unit for attenuating vibrations of the tension mask assembly due to external impacts so that a howling phenomenon and lowering of resolution of an image can be prevented.

It is another objective to have tension mask that provides a stable image for a cathode-ray tube.

It is yet another object to have a tension mask that is easy to manufacture.

Accordingly, to achieve the above objectives, there is provided a tension mask assembly for a color cathode-ray tube having a tension mask including a plurality of strips separated a predetermined distance from each other to form slots, a plurality of bridges connecting the strips to section the slots, and a plurality of holes formed in each of short side portions of the tension mask, a frame including first and second support members supporting both long side portions of the tension mask to apply a tension force to the strips of the tension mask, and at least a pair of elastic members supporting the first and second support members, and a plurality of vibration attenuation units coupled to the holes formed at both short side portions of the tension mask to attenuate vibrations of the tension mask.

It is preferred in the present invention that at least one of both end portions of the vibration attenuation units is bent so as not to be separated from each of the holes of both short side portions of the tension mask.

Also, it is preferred in the present invention that the vibration attenuation unit is formed of a material having density greater than that of the tension mask.

Also, it is preferred in the present invention that at least one end portion of the vibration attenuation unit is bent at least two times to encompass an outside edge portion of each of the holes so that the vibration attenuation unit can be secured with respect to the outside edge portion of each of the holes of both short side portions of the tension mask.

Also, it is preferred in the present invention that the vibration attenuation unit has an insertion portion inserted in each of the holes of both side portions of the tension mask to which the vibration attenuation unit is coupled, a connection portion extending from the insertion portion and bent to encompass the outside edge portion of each of the holes, and an extension portion extending from the connection portion and bent toward the insertion portion.

Also, it is preferred in the present invention that the extension portion is further bent toward the outside edge portion of each of the holes while encompassing the outside edge portion.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
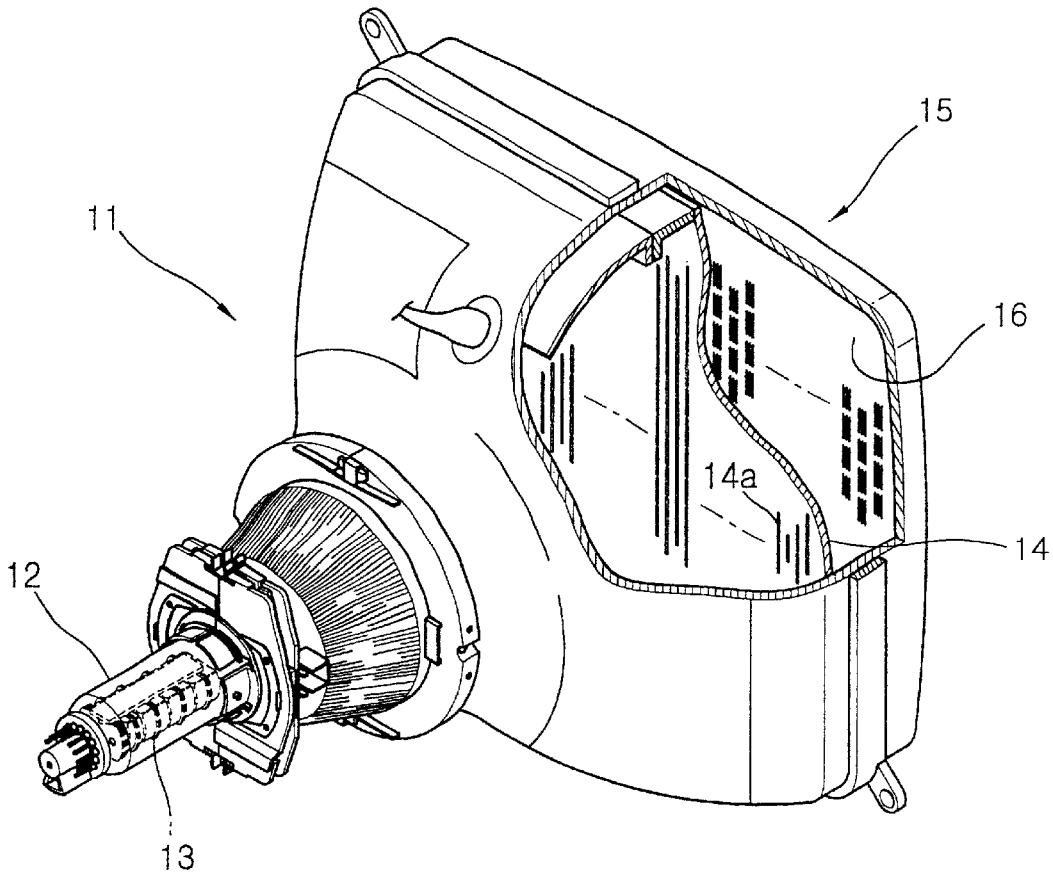
FIG. 1 is a partially cut-away perspective view of an earlier color cathode-ray tube.

Turning now to the drawings, in a typical color cathode-ray tube, as shown in FIG. 1, an electron gun 13 installed in a neck portion 12 of a funnel 11 emits three types of electron beams of red, green and blue colors. These electron beams pass through hundreds of thousands of electron beam passing holes 14*a* formed in the surface of a shadow mask 14 having a color selection function. The electron beams passing through the electron beam passing holes 14*a* land at red, green and blue fluorescent materials of a fluorescent film 16 formed on the inner surface of a panel 15 which is coupled to the funnel 11 forming a seal. Thus, the fluorescent materials are excited so that a predetermined image is formed.

In the above color cathode-ray tube, to improve a view angle of a view and prevent distortion of an image, making a flat screen surface has been required. Accordingly, the shadow mask installed inside the color cathode-ray tube and having a color selection function is needed to be made flat.

Figure 2:
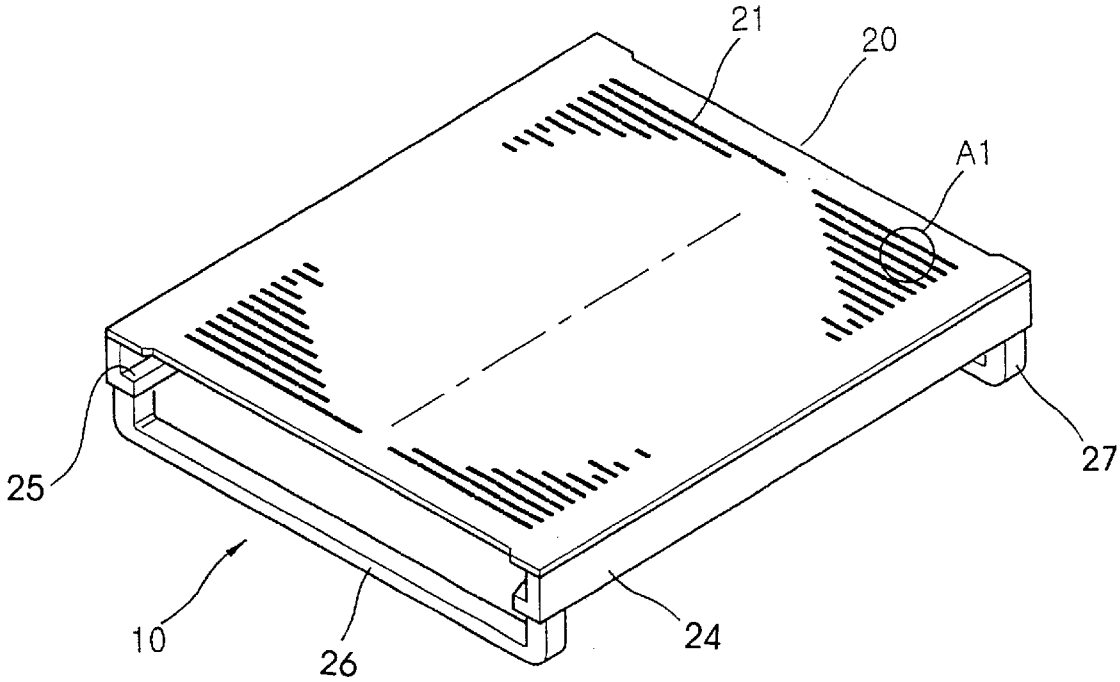
FIG. 2 is a perspective view of an earlier tension mask assembly for a color cathode-ray tube.
Figure 3:
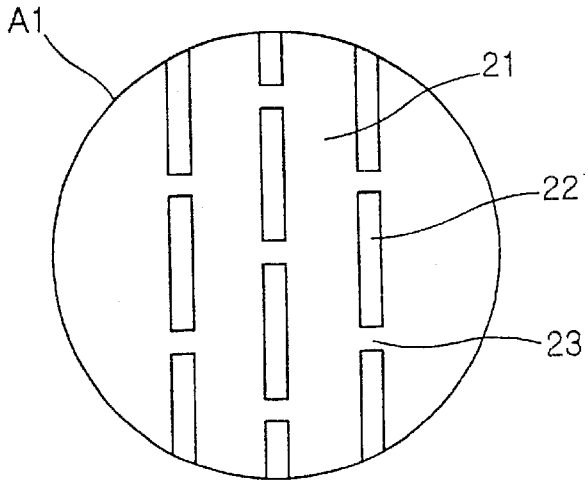
FIG. 3 is a plan view showing portion of the tension mask of FIG. 2.

For this purpose, in an earlier shadow mask of a color cathode-ray tube, as shown in FIGS. 2 and 3 which is a magnified view of a portion A1 of FIG. 2, a frame 10 includes first and second support members 24 and 25 installed parallel to each other and first and second elastic members 26 and 27 of which end portions are secured to each of the first and second support members 24 and 25. A flat type tension mask 20 having slots 22 having electron beam passing holes formed in strips therein as a plurality of strips 21 are connected by bridges 23 is welded to the first and second support members 24 and 25 while a tension force is applied thereto.

However, in the earlier tension mask assembly for a color cathode-ray tube, the tension mask 20 formed of a thin plate having a thickness of 0.1 through 0.25 mm (millimeters) is welded A. to the frame 10 by being tensioned. In particular, since only the long side edges thereof are secured to the support members 24 and 25 while the short side edges hereof are not secured, the tension mask 20 easily vibrates by small impacts applied from the outside.

Figure 4:
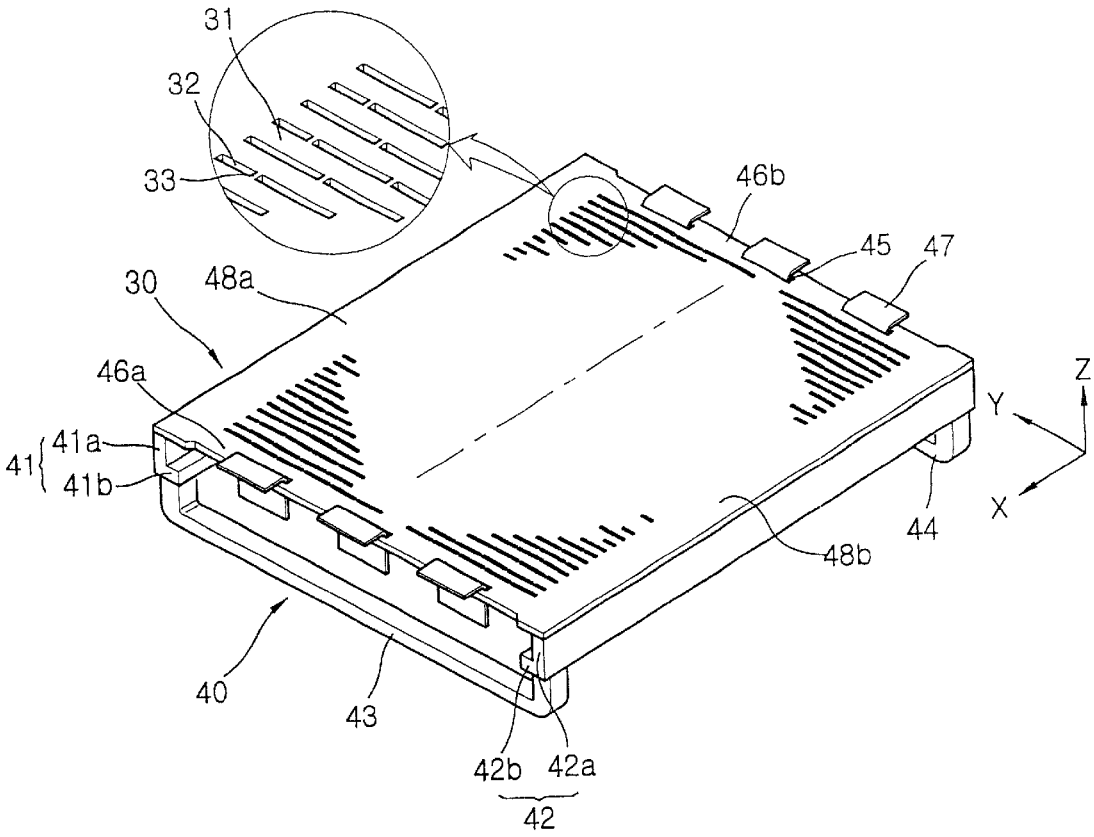
FIG. 4 is a perspective view of a tension mask assembly for a color cathode-ray tube according to a preferred embodiment of the present invention.
Figure 5:
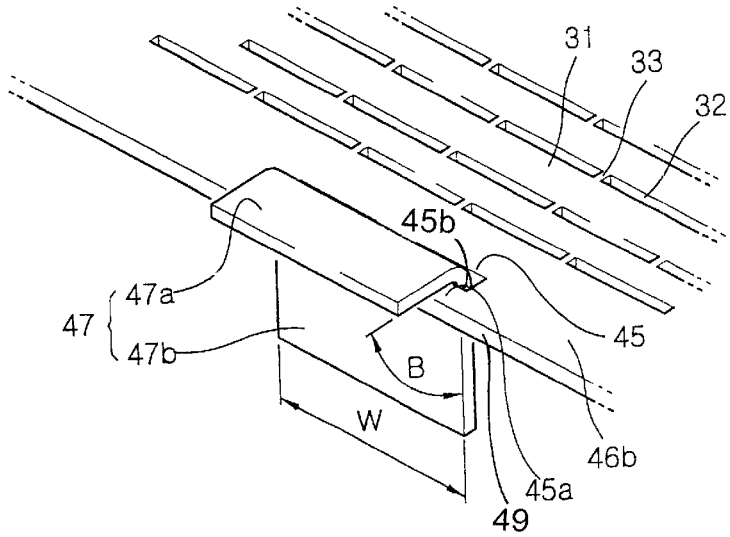
FIG. 5 is a perspective view showing portion of a vibration attenuation unit coupled to a hole of a short side of the tension mask of FIG. 4.

Referring to FIGS. 4 and 5, a tension mask assembly for a color cathode-ray tube according to a preferred embodiment of the present invention includes a tension mask 30, a frame 40, and a plurality of vibration attenuation units 47. The tension mask 30 includes a plurality of strips 31 separated a predetermined distance from each other to form slots 32, a plurality of bridges 33 connecting the strips 31 to section the slots 32, and a plurality of holes 45 formed in each of short side portions 46*a* and 46*b* of the tension mask 30. The frame 40 includes first and second support members 41 and 42 supporting both long side portions 48*a* and 48*b* of the tension mask 30 to apply a tension force to the strips 31 of the tension mask 30, and at least a pair of elastic members 43 and 44 supporting the first and second support members 41 and 42. The vibration attenuation units 47 coupled to the holes 45 formed at both short side portions 46*a* and 46*b* of the tension mask 30 to attenuate vibrations of the tension mask 30.

Here, although three holes 45 are formed at each of the short side portions 46*a* and 46*b* in the preferred embodiment shown in FIG. 4, the number of the holes 45 is not limited thereto and a variety of modifications thereto may be possible within the scope of the present invention.

Preferably, the holes 45 are located at a non-holed area (having no slots) of each of both short side portions 46*a* and 46*b* and have elongated shapes parallel to the slots 32 of the tension mask 30. The width of each of the holes 45 is preferably thin considering the thickness of an end portion of the vibration attenuation unit 47 coupled thereto, so that the vibration attenuation unit 47 can be firmly secured to the tension mask 30, improving an effect of attenuating vibrations. The lengths of the holes 45 are not limited but can be determined within the scope of the present invention. Preferably, the length of each hole 45 is set to be almost the same as or slightly greater than the width of each vibration attenuation unit 47. The holes 45 can be formed by an etching method as in the case of the slots 32 of the tension mask 30.

The first and second support members 41 and 42 of the frame 40, each having a section of an L-shape, have securing portions 41*a* and 42*a* and flange portions 41*b* and 42*b* extending inwardly from the lower ends of the securing portions 41*a* and 42*a*. The first and second elastic members 43 and 44 of the frame 40, each being formed to be a U-shape and having a rectangular or L-shaped section, are coupled to the end portions of the first and second support members 41 and 42 to support the first and second support members 41 and 42.

Although the frame 40 is described to have the first and second support members 41 and 42 and the first and second elastic members 43 and 44 supporting the first and second support members 41 and 42, any structure capable of applying a tension force to the tension mask 30 in a Y direction can be adopted. Alternatively, to apply a uniform tension force to the tension mask 30, both ends of the first and second elastic members 43 and 44 supporting the first and second support members 41 and 42 can be secured at positions inwardly separated a predetermined distance from the end portions of the first and second support members 41 and 42 in an X direction.

Any means capable of attenuating vibrations of the tension mask 30 by being coupled to the holes 45 of the tension mask 30 may be adopted as the vibration attenuation unit 47. One end portion 47*a* of the vibration attenuation unit 47 is bent so as not to escape from each of the holes 45 at either short side portions of the tension mask 30, as shown in FIG. 5. Here, the angle of bending of the end portion 47*a* of the vibration attenuation unit 47, that is, an angle B made by the end portion 47*a* and an insertion portion 47*b* of the vibration attenuation unit 47 inserted in each of the holes 45, is appropriately determined so that the vibration attenuation unit 47 cannot be separated from, the tension mask 30 when the tension mask assembly is installed at a color cathode-ray tube. For example, the angle B is preferably set to be less than or equal to 90 degrees so that the vibration attenuation unit 47 can be firmly secured to an outside edge portion 45*a* of each of the holes 45. The outside edge portion 45*a* of the hole 45 can be defined as the area adjacent to the hole 45 between the short-side edge 49 of the tension mask 30 to the outside periphery 45*b* of the hole being towards the edge 49 of the tension mask 30.

The width W of the vibration attenuation unit 47 is preferably less than or almost the same as the length of each of the holes 45. Also, the length of the vibration attenuation unit 47 is preferably suitable for attenuating vibrations of the tension mask 30 due to friction between the vibration attenuation unit 47 and the short side portions 46*a* and 46*b* of the tension mask 30 and the weight of the vibration attenuation unit 47 and simultaneously is long so as not to contact the frame 40.

Also, the thickness of the vibration attenuation unit 47 is preferably less than or almost the same as the thickness of each of the hole 45, so that the vibration attenuation unit 47 is firmed secured to the tension mask 30, thus improving an effect of attenuating vibrations. However, the thickness of the vibration attenuation unit 47 is not limited to the above and a variety of modification thereof may be possible within the scope of the present invention. The vibration attenuation unit 47 preferably has density greater than that of the tension mask 30. Accordingly, vibrations of the tension mask 30 can be more effectively attenuated.

Figure 6:
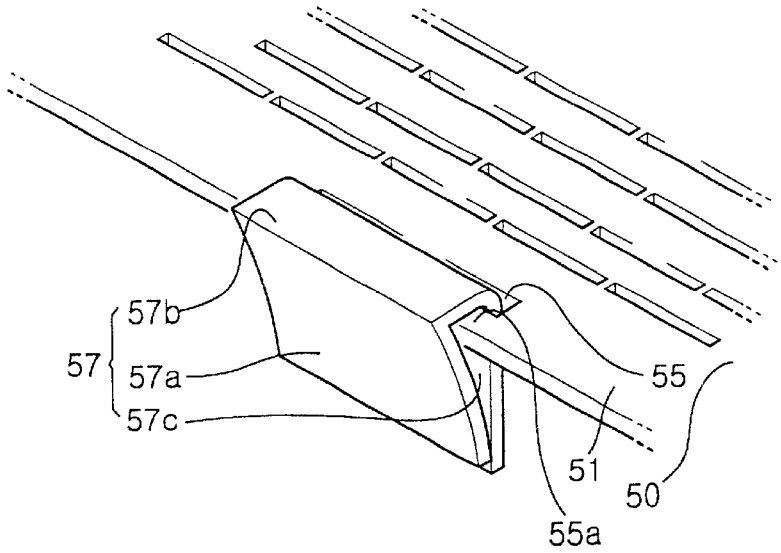
FIGS. 6 and 7 are perspective views showing a vibration attenuation unit coupled to a hole of the short side portion of the tension mask according to each of the other preferred embodiments of the present invention.

FIG. 6 shows a vibration attenuation unit coupled to a hole of the short side portion of the tension mask according to another preferred embodiment of the present invention. Here, the tension mask assembly for a color cathode-ray tube according to another preferred embodiment of the present invention, as shown in FIG. 6, has the same structure as that described with reference to FIGS. 4 and 5 except for the vibration attenuation unit. Thus, differences of a vibration attenuation unit 57 from the vibration attenuation unit according to the above-described preferred embodiment will be set forth, while the descriptions of the same elements will be omitted.

Unlike the vibration attenuation unit 47 according to the above embodiment, the vibration attenuation unit 57 has an insertion portion 57*c* inserted in each of the holes 55 formed in both short side portions 51 of a tension mask 50, a connection portion 57*b* extending from the insertion portion 57*c* and bent to encompass an outside edge portion 55*a* of each of the holes 55, and an extension portion 57*a* extending from the connection portion 57*b* to bend toward the insertion portion 57*c*. Thus, the vibration attenuation unit 57 is further firmly secured to the tension mask 50 so that the vibration attenuation unit 57 is prevented from being separated from the tension mask 50, due to external impacts.

Figure 7:
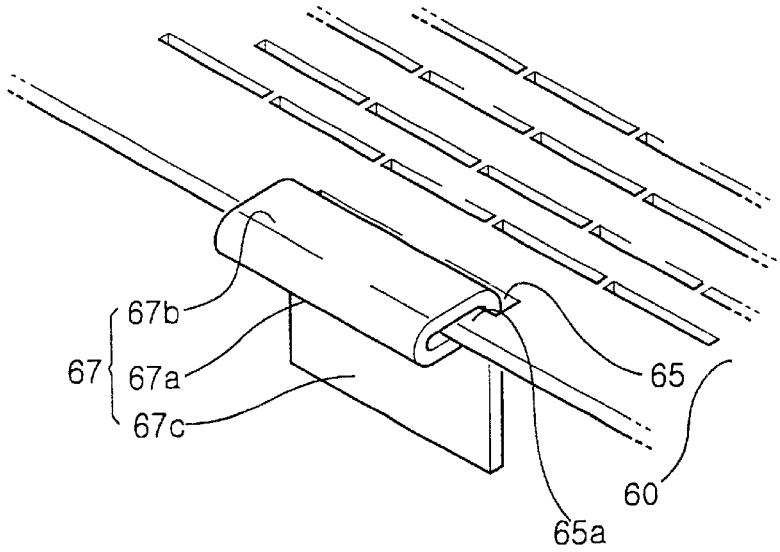

FIG. 7 shows a vibration attenuation unit coupled to a hole of the short side portion of the tension mask according to yet another preferred embodiment of the present invention. Here, since the elements other than the vibration attenuation unit are the same as those in the above preferred embodiments, descriptions thereof will be omitted.

A vibration attenuation unit 67 includes an insertion portion 67*c*, a connection portion 67*b*, and an extension portion 67*a*, like the vibration attenuation unit 57 according to another preferred embodiment shown in FIG. 6. However, the extension portion 67*a* extending from the connection portion 67*b* and bent toward the insertion portion 67*c* is further bent toward an outside edge portion 65*a* of a hole 65 while encompassing the outside edge portion 65*a*, which is different from the vibration attenuation unit 57 of FIG. 6. Accordingly, the vibration attenuation unit 67 is further firmly secured to a tension mask 60 so that the vibration attenuation unit 67 is prevented from being separated from the tension mask 60, and an effect of attenuating vibrations is further improved.

In the operation of the vibration attenuation unit of the present invention having the above structure, referring to FIGS. 4 and 5, the first and second support members 41 and 42 are supported and pressed in the opposite directions by the first and second elastic members 43 and 44 which are elastically deformed. In this state, since the long side portions 48*a* and 48*b* of the tension mask 30 are welded to the securing portions 41*a* and 42*a* of the first and second support members 41 and 42, a tension force is applied to the tension mask 30 in the lengthwise direction of the strips 31.

The tension mask 30 receiving a tension force only in the lengthwise direction of the strips 31, of which the short side portions 46*a* and 46*b* are not secured to the frame 40, easily vibrates in the X or Z direction when a small external impact is applied.

However, since the vibration attenuation unit 47 is coupled to a plurality of the holes 45 (three in the case of the tension mask shown in FIGS. 4 and 5) formed at each of the short side portions 46*a* and 46*b* of the tension mask 30, the vibrations of the tension mask 30 in the X or Z direction can be drastically attenuated due to friction between the vibration attenuation unit 47 and the short side portions 46*a* and 46*b* of the tension mask 30 and the weight of the vibration attenuation unit 47.

In particular, when the vibration attenuation unit 47 is formed of a material having density greater than that of the tension mask 30, the effect of attenuating vibrations is improved owing to not only the friction but also the weight of the vibration attenuation unit itself.

As described above, in the tension mask assembly for a color cathode-ray tube of the present invention, since the holes are formed in a non-holed area of the short side portions of the tension mask along the lengthwise direction of the slots and the vibration attenuation unit is coupled to each of the holes, vibrations of the tension mask, in particular, vibrations in the directions perpendicular to the lengthwise direction of the slots, can be remarkably attenuated by the friction between the vibration attenuation unit and the non-hole area of the short side portions of the tension mask and the weight of the vibration attenuation unit itself.

Therefore, in the case of using the tension mask assembly for a color cathode-ray tube according to the present invention, the howling phenomenon and the lowering of resolution of an image can be prevented which are generated because electron beams emitted from the electron gun do not accurately pass the electron beam passing holes due to vibrations of the tension mask and thus the beams cannot land at a predetermined position on the fluorescent film.

It is noted that the present invention is not limited to the preferred embodiment described above, and it is apparent that variations and modifications by those skilled in the art can be affected within the spirit and scope of the present invention defined in the appended claims.

What is claimed is:

1. A tension mask assembly for a color cathode-ray tube, comprising:

a tension mask including a plurality of strips separated a predetermined distance from each other to form slots, a plurality of bridges connecting the strips to section the slots, and a plurality of holes formed in each of short side portions of the tension mask;

a frame including first and second support members supporting both long side portions of the tension mask to apply a tension force to the strips of the tension mask, and at least a pair of elastic members supporting the first and second support members; and a plurality of vibration attenuation units coupled to the holes formed at both short side portions of the tension mask to attenuate vibrations of the tension mask, with one end portion of one of the vibration attenuation units being bent so as not to be separated from a hole of the tension mask, with the one of the vibration attenuation units being firmly secured to the tension mask.

2. The assembly as claimed in claim 1, with at least one end portion of two vibration attenuation units being bent so as not to be separated from each of the holes of both short side portions of the tension mask, the end portion being bent to accommodate the vibration attenuation units being firmly secured to an outside edge portion of the holes.

3. The assembly as claimed in claim 1, the vibration attenuation unit being formed of a material having density greater than that of the tension mask.

4. The assembly as claimed in claim 1, with at least one end portion of the vibration attenuation unit being bent at least two times to encompass an outside edge portion of each of the holes accommodating the vibration attenuation unit to be secured with respect to the outside edge portion of each of the holes of both short side portions of the tension mask, with the outside edge portion being between the outside edge of the hole facing the edge of the tension mask to the edge of the tension mask.

5. The assembly as claimed in claim 1, the vibration attenuation unit having an insertion portion inserted in each of the holes of both side portions of the tension mask where the vibration attenuation unit is coupled, a connection portion extending from the insertion portion and bent to encompass the outside edge portion of each of the holes, and an extension portion extending from the connection portion and bent toward the insertion portion.

6. The assembly as claimed in claim 5, the extension portion being further bent toward the outside edge portion of each of the holes while encompassing the outside edge portion.

7. The assembly as claimed in claim 6, with the outside edge portion being between the outside edge of the hole facing the edge of the tension mask to the edge of the tension mask.

8. The assembly as claimed in claim 1, with each of the holes being at least substantially equal to the width of each vibration attenuation unit.

9. The assembly as claimed in claim 1, with each of the holes being substantially equal to the width of each vibration attenuation unit.

10. The assembly as claimed in claim 2, further comprising the angle the end portion is bent being less than or equal to 90 degrees accommodating the attenuation unit to be secured to an outside edge portion of the hole.

11. The assembly as claimed in claim 1, the vibration attenuation unit comprising an extension portion extending from the connection portion and bent toward an insertion portion, the extension portion being further bent toward an outside edge portion of the hole while encompassing the outside edge portion, the insertion portion being inserted in one of the holes, the connection portion being bent from the insertion portion.

12. The assembly as claimed in claim 11, with the insertion portion protruding downward from the hole in the tension mask.

13. The assembly as claimed in claim 12, with the vibration in the tension mask being attenuated according to the friction between the vibration attenuation unit and the short side portions of the tension mask and the weight of the vibration attenuation unit.

14. The assembly as claimed in claim 1, the length of the vibration attenuation unit being set suitable for attenuating vibrations of the tension mask due to friction between the vibration attenuation unit and the short side portions of the tension mask and the weight of the vibration attenuation unit and avoiding contact with the frame.

15. (Currently Amended) A tension mask assembly for a color cathode-ray tube, comprising:

a tension mask;

a frame supporting the tension mask; and a plurality of vibration attenuation units coupled to the tension mask through the holes formed at both short side portions of the tension mask to attenuate vibrations of the tension mask, at least one end portion of two vibration attenuation units being bent at an angle so as not to be separated from each of the holes of both short side portions of the tension mask.

16. The assembly as claimed in claim 15, the vibration attenuation unit being formed of a material having density greater than that of the tension mask.

17. The assembly as claimed in claim 15, with at least one end portion of the vibration attenuation unit being bent at least two times to encompass an outside edge portion of each of the holes accommodating the vibration attenuation unit to be secured with respect to the outside edge portion of each of the holes of both short side portions of the tension mask, with the outside edge portion being between the outside edge of the hole facing the edge of the tension mask to the edge of the tension mask.

18. The assembly as claimed in claim 15, the vibration attenuation unit having an insertion portion inserted in each of the holes of both side portions of the tension mask where the vibration attenuation unit is coupled, a connection portion extending from the insertion portion and bent to encompass the outside edge portion of each of the holes, and an extension portion extending from the connection portion and bent toward the insertion portion.

19. The assembly as claimed in claim 18, the extension portion being further bent toward the outside edge portion of each of the holes while encompassing the outside edge portion.

20. The assembly as claimed in claim 19, with the outside edge portion being between the outside edge of the hole facing the edge of the tension mask to the edge of the tension mask.

21. The assembly as claimed in claim 15, with each of the holes being substantially equal to or greater than the width of each vibration attenuation unit.

22. The assembly as claimed in claim 15, with each of the holes being substantially equal to the width of each vibration attenuation unit.

23. The assembly as claimed in claim 15, further comprising the angle the end portion is bent being less than or equal to 90 degrees accommodating the attenuation unit to be secured to an outside edge portion of the hole.

24. The assembly as claimed in claim 15, the vibration attenuation unit comprising an extension portion extending from the connection portion and bent toward an insertion portion, the extension portion being further bent toward an outside edge portion of the hole while encompassing the outside edge portion, the insertion portion being inserted in one of the holes, the connection portion being bent from the insertion portion.

25. The assembly as claimed in claim 24, with the insertion portion protruding downward from the hole in the tension mask.

26. The assembly as claimed in claim 25, with the vibration in the tension mask being attenuated according to the friction between the vibration attenuation unit and the short side portions of the tension mask and the weight of the vibration attenuation unit.

27. The assembly as claimed in claim 15, the length of the vibration attenuation unit being set suitable for attenuating vibrations of the tension mask due to friction between the vibration attenuation unit and the short side portions of the tension mask and the weight of the vibration attenuation unit and avoiding contact with the frame.

28. The assembly as claimed in claim 15, with the frame providing tension to the tension mask being in the Y direction, the Y direction being parallel with the shorter sides of the tension mask.

* * * * *